US005199008A

United States Patent [19]

Lockhart et al.

[11] Patent Number: 5,199,008

[45] Date of Patent: Mar. 30, 1993

[54] DEVICE FOR DIGITALLY MEASURING INTERVALS OF TIME

[75] Inventors: Walter L. Lockhart; Benjamin M. Piepgrass, Jr., both of San Antonio, Tex.

[73] Assignee: Southwest Research Institute, San Antonio, Tex.

[21] Appl. No.: 493,507

[22] Filed: Mar. 14, 1990

[51] Int. Cl.[5] ..... G04F 8/00

[52] U.S. Cl. ..... 368/117; 368/120

[58] Field of Search ..... 368/113-120

[56] References Cited

U.S. PATENT DOCUMENTS

| | | | |
|---|---|---|---|
| 3,675,127 | 7/1972 | McKiernan | 368/120 |
| 4,439,046 | 3/1984 | Hoppe | 368/120 |
| 4,516,861 | 5/1985 | Frew et al. | 368/120 |
| 4,595,992 | 6/1986 | Drogin | 364/569 |
| 4,875,201 | 10/1989 | Dalzell | 368/120 |
| 4,933,898 | 6/1990 | Nuytkens et al. | 364/721 |

OTHER PUBLICATIONS

Browne, "Compact IFM Module Tracks Fast Pulses From 125 to 250 MHz", *Microwaves & RF*, Sep. 1989, pp. 161-165.

Kleinfelder, et al., "MTD132-A New Sub-Nanosecond Multi-hit CMOS Time-to-Digital Converter", Nov., 1990.

*Primary Examiner*—Bernard Roskoski

*Attorney, Agent, or Firm*—Baker & Botts

[57] ABSTRACT

An apparatus for measuring intervals of time, which requires only a simple counter circuit (15) and delay circuit (17), through which electrical pulses travel. The counter circuit (15) counts pulses during the time interval. During each count of the counter circuit (15), the delay circuit (17) tracks the position of the pulse. The output of the two circuits are a counter word and a vernier word, such that the counter word may be multiplied by the period of each pulse, and the product added to the vernier word, to obtain the time interval measurement. The apparatus may also be used for frequency measurement.

12 Claims, 3 Drawing Sheets

| DELAY LINE OUTPUT (16 TAPS SHOWN) | VERNIER ENCODER OUTPUT (BINARY) | (DEC) | COUNTER OUTPUT (DEC) |
|---|---|---|---|
| MSB LSB | | | |
| 0000000011111111 | 0111 | 7 | 0 |
| 0000000111111110 | 1000 | 8 | 0 |
| 0000001111111100 | 1001 | 9 | 0 |
| 0000011111111000 | 1010 | 10 | 0 |
| 0000111111110000 | 1011 | 11 | 0 |
| 0001111111100000 | 1100 | 12 | 0 |
| 0011111111000000 | 1101 | 13 | 0 |
| 0111111110000000 | 1110 | 14 | 0 |
| 1111111100000000 | 1111 | 15 | 0 |
| 1111111000000001 | 0000 | 0 | 1 |
| ← INCREASING TIME ↑ LEAD BIT | ⋮ | ⋮ | ⋮ |

DEVICE FOR DIGITALLY MEASURING INTERVALS OF TIME

BACKGROUND OF THE INVENTION

It is often desirable to measure very small intervals of time with a great deal of accuracy. For example, mass spectroscopy requires accurate particle flight time measurement, in which a particle's velocity is determined by measuring its transit time across a known distance. Other examples of applications requiring accurate time measurement are radar, navigation, range finding, and ballistics.

Existing time interval measurement methods fall within two broad categories: time to amplitude conversion and time to digital conversion. The first method converts a time interval to a proportional pulse amplitude. The second method converts a time interval into a digital value. A problem with the first method is susceptibility to noise, and a problem with both methods is the need for special interface circuitry to provide a digital output that may be easily converted to a time measurement.

For example, one existing implementation of the time to digital conversion method uses a periodic system clock synchronized to the event of interest. The time interval is measured by counting oscillator pulses with a counter. For vernier resolution, the oscillator pulses are fed to a tapped delay line that divides the oscillator period. The delay line taps are used as addresses to a random access memory where a read, add one, and write routine is performed every oscillator period. In this manner, each time interval representing an event is represented by output from the counter and the random access memory. An additional conversion process must operate on this data to produce the measured time interval.

Pulse counting devices are also used for frequency measurement. In some applications, pulse to pulse measurements, as well as measurements of the number of pulses, are desired. In this connection, the ability to examine transient signals, such as a single pulse, is useful.

A need exists for a time or frequency measurement device that simplifies circuitry and thereby minimizes weight and size. In this regard, the mass and size of prior devices have limited their usefulness for space borne applications. Additionally, the device should not compromise accuracy and speed, and should permit the propagation of a single pulse to be examined.

SUMMARY OF THE INVENTION

A first aspect of the invention is an apparatus for measuring intervals of time comprised of a pulse generator, a counter circuit, and a delay circuit. The counter circuit and the delay circuit both receive pulses generated by the pulse generator. The counter circuit produces a counter word that represents the number of pulses, whereas the delay circuit encodes a vernier word having a lead bit that represents the propagation of a single pulse. These two words may be used to obtain the time interval by multiplying the counter word times the period of the pulse generator and adding the product to the vernier word.

Another aspect of the invention is a device for counting pulses. A counter circuit has a counter and a counter memory, and receives pulses from a pulse signal source. A delay circuit has a tapped delay line, a vernier data memory, and an encoder, with the tapped delay line also receiving pulses from the pulse source.

Another aspect of the invention is a method of measuring time intervals comprised of the steps of activating a pulse generator in response to a start signal, delivering output of the pulse generator to a counter, delivering output of the pulse generator to a delay line having a number of taps, and encoding the output of the delay line to represent the position of each pulse during one count. The time interval is then represented by a counter word and a vernier word.

Another aspect of the invention is a digital processor circuit for measuring time intervals. In addition to the pulse generator, counter circuit, and delay circuit described above, the invention comprises a processor programmed to multiply the counter word times the period of the pulse generator and add the product to the vernier word.

A technical advantage of the invention is that it provides a simple and economic means for accurately measuring the time interval of an event. The invention provides a digital word, which represents both a frequency count and a vernier measurement, and which can be easily converted to a time or a frequency measurement. Implementations of the device may be small and lightweight. Another advantage of the invention is that it permits a high rate of processing of events.

BRIEF DESCRIPTION OF THE DRAWINGS

The novel features believed characteristic of the invention are set forth in the appended claims. The invention itself, however, as well as modes of use and further advantages, is best understood by reference to the following description of illustrative embodiments when read in conjunction with the accompanying drawings.

DETAILED DESCRIPTION OF THE INVENTION

Figure 1:
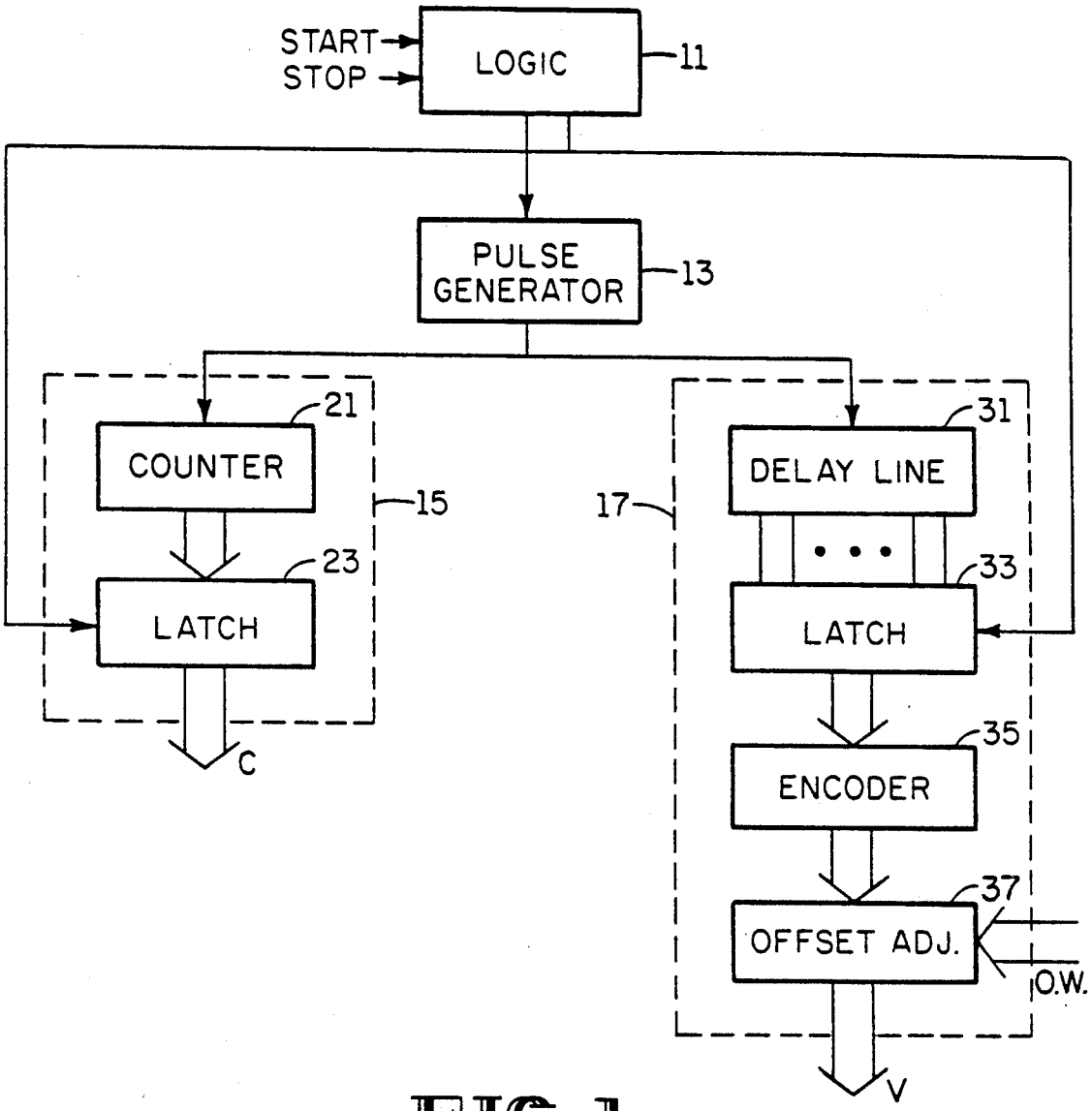
FIG. 1 is a block diagram of the apparatus of the invention.

Referring to the block diagram of FIG. 1, a first aspect of the invention is an apparatus for measuring intervals of time. The apparatus has four basic circuits: a logic circuit 11, a pulse generator 13, a counter circuit 15, and a delay circuit 17.

Logic circuit 11 is comprised of various logic devices that accept both start and stop signals, corresponding to the stop and start of the time interval being measured. Upon receipt of a start signal, logic circuit 11 delivers an enable signal to pulse generator 13. Upon receipt of a stop signal, logic circuit 11 delivers a signal to the counter circuit 15 and delay circuit 17, such that information in both circuits is stored. Logic circuit 11 also delivers a signal to counter circuit 15 to ensure that each time a new time interval is to be measured, the counting devices of that circuit are first cleared.

Pulse generator 13 is comprised of any one of a number of well known means for generating a controlled series of electrical pulses. In fact, any oscillator means that provides an alternating current output at a controlled frequency may be used, so long as distinct maximum and minimum values can be discerned. The frequency of the output is set by some external means, such as an external voltage or by a resistor-capacitor combination. In the preferred embodiment, pulse generator 13 is a gated oscillator. Upon receipt of an enable signal from logic circuit 11, pulse generator 13 begins generating pulses at a set and predetermined frequency.

Counter circuit 15 is comprised of a counter 21 and a counter latch 23. The purpose of counter circuit 15 is to count and store the number of pulses in a given time period. As indicated below, both counter 21 and latch 23 are standard digital devices, and in the preferred embodiment, are integrated circuits.

Counter 21 is in communication with pulse generator 13 and logic circuit 11. Upon receipt of pulse signals from pulse generator 13, counter 21 counts the number of pulses received. The output of counter 21 is delivered to course resolution latch 23. Counter 21 may be any one of a number of well known devices for measuring the frequency of an input signal.

Counter 21 is coupled to latch 23. Upon receipt of a latch signal from logic circuit 11, latch 23 stores the present count of counter 21. Latch 23 may be any of a number of well known memory devices. The essential characteristic of latch 23 is that it respond to a latch signal delivered from logic circuit 11, by storing its own contents until cleared or until the data is read out to another device. Latch 23 has whatever number of input and outputs as is necessary to store the output of counter 21. For example, if the maximum output of counter 21 is to be $1111_2 = 15_{10}$, latch 23 is a 4-bit latch, resulting in a 4-bit counter word. As explained below, the output of counter circuit 15 may be delivered to various data collection and processing devices. Delay circuit 17 is comprised of a delay line 31, a delay latch 33, an encoder 35, and an offset adjustment circuit 37. The purpose of delay circuit 17 is to obtain a measure of time between counts of counter circuit 15. As explained below, delay circuit 17 produces a desired degree of resolution, i.e., a vernier, within measured intervals of counter circuit 15. Like the elements of counter circuit 15, the elements of delay circuit 17 may be comprised of well known devices, which are available as integrated circuits.

Delay line 31 also receives the pulse output of pulse generator 13. The pulse transit time through delay line 31 is equal to one period, $T_o$, of pulse generator 13. The pulse loops through delay line 31 once for each increment of counter 21. Delay line 31 is tapped with n number of taps, with the taps providing a vernier function. The minimum resolvable time is $T_o/n$, thus the minimum resolvable time increment for a given output frequency of pulse generator 13, $f_o$, is:

$$T_{min} = \frac{1/f_n}{n}$$

As explained below, an encoder 35 used with delay circuit 17 is binary, and thus n is a power of 2.

Delay line 31 may be implemented with any one of a number of well known delay line components. Examples of implementations of delay line 31 are: coaxial transmission lines, strip lines, microstrip lines, logic gate delays, passive component networks, surface acoustical wave devices, and bulk acoustical wave devices. The essential characteristic of delay line 31 is that it is used to delay a signal for a known length of time.

Delay latch 33 latches the output of delay line 31 upon receipt of the latch signal, which is output from logic circuit 11 in response to the end of the time interval being measured. Like counter latch 23, delay latch 33 may be any of a number of well known memory devices. Delay latch 33 is not necessarily transparent, as is the latch used in the alternative embodiment of FIG. 3, and may be comprised of flip-flops. The number of inputs to latch 33 is the same as the number of taps on delay line 31.

Encoder 35 encodes the contents of latch 33 as a binary word, as explained below in connection with FIGS. 4 and 5. Because the length of delay line 31 matches the period of pulse generator 13, the output of encoder 35 cycles through a zero state during every counter transition.

Offset circuit 37 eliminates any offset between counter 21 and encoder 35. Once the output of delay line 31 has been encoded, the vernier word must go to zero on the increment boundaries of counter 21. Yet, this is complicated by timing delays and set-up time requirements for digital logic. Hence, the desirability of offset circuit 37.

Figure 2:
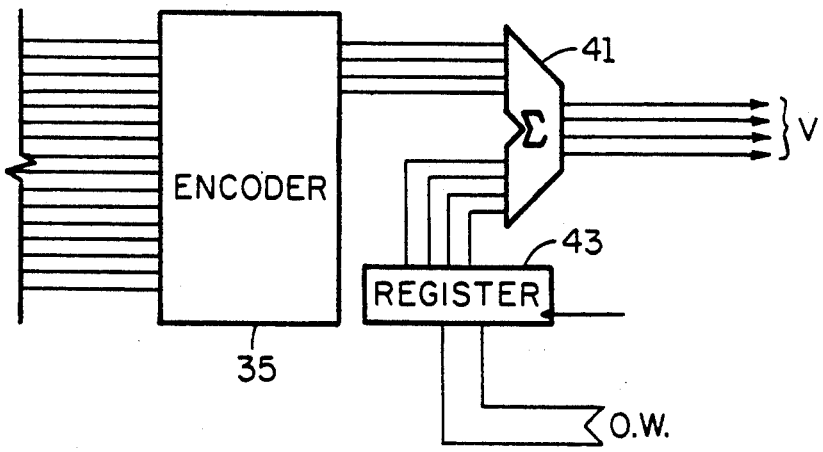
FIG. 2 is a block diagram of the offset circuit of FIG. 1.

An implementation of offset circuit 37 is shown in FIG. 2, which is configured for a delay line having 16 taps and a 4-bit vernier word. In this embodiment, offset circuit 37 is comprised of an adder 41 and a register 43. This circuit adds a fixed offset value to the output of encoder 35 to align its bit positions with those of counter 21 to permit proper incrementing of the counter word in relation to the vernier word. The built-in delay in delay circuit 17 ensures addition of a positive value to eliminate offset. As shown in FIG. 2, register 43 receives an offset word and is activated by the same latch signal that is delivered to latches 23 and 33. For example, using the same word sizes in the examples above, one output of delay line could be:

$$\underset{2^{12}}{0\ 0\ 0\ 1}\ 1\ 1\ 1\ 1\ 1\ 1\ 1\ 0\ 0\ 0\ 0\ \underset{2^{0}}{0}$$

where the bit positions are as indicated. Counter 21 should advance on the $2^0$ boundary. But, if for example, counter 21 actually advances on the $2^{13}$ boundary, an offset adjustment of $2^3$ counts is required. This offset is provided by a value in register 43.

Figure 3:
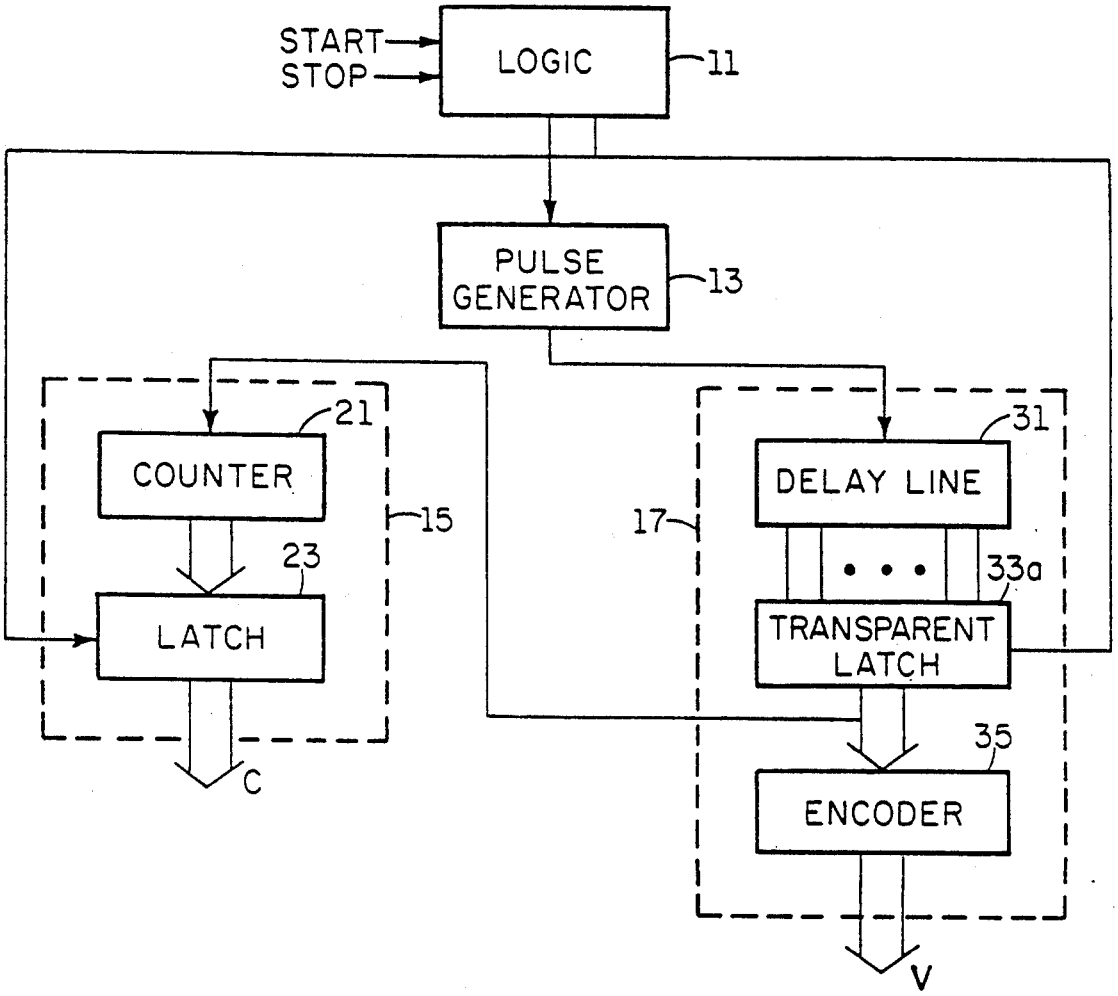
FIG. 3 is a block diagram of an alternative embodiment of the apparatus of FIG. 1.

FIG. 3 is a block diagram of an alternative embodiment of the invention that avoids the need for offset circuit 37. As indicated in FIG. 3, a transparent latch **33*a* is substituted for delay latch 33. An output of transparent latch 33*a* is connected to the clock of counter 21. In this manner, counter 21 is synchronized to the output of encoder 35. The outputs of transparent latch 33*a* are active when enabled by logic circuit 11. Counter 21 advances with each clock pulse from pulse generator 13 after the pulse propagates through delay line 31 and transparent latch 33*a***.

Figures 4, 5:
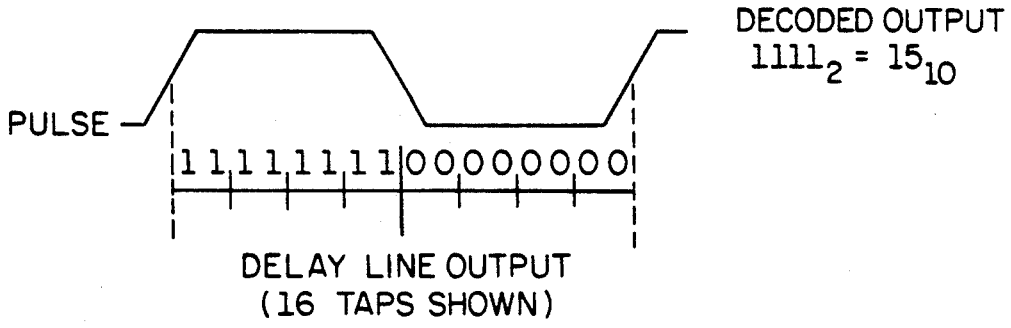
FIG. 4 is a table illustrating an example of the outputs of the delay line, encoder, and counter of FIGS. 1 and 3.
FIG. 5 is a diagram of the relationship between the length of the delay associated with the delay line of FIGS. 1 and 3, and a single period of the pulse generator of FIGS. 1 and 3.

FIG. 4 illustrates an example of the output of the circuits of FIGS. 1 and 3. More specifically, FIG. 4 illustrates the output of delay line 31, as captured by delay latch 33 and encoder 35, with respect to the output of counter 21. Again, in this example, delay line 31 has 16 taps and the vernier word is 4 bits. It should be understood, however, that subject to the binary considerations explained below, the number of taps and the size of the vernier word may be varied.

As indicated in FIG. 4, the output of delay line 31 is encoded into a binary word, having a lead bit, which represents the position of the pulse as the pulse advances through delay line 31. The length of the vernier word is related to the desired vernier resolution, with a preferred method of obtaining these parameters being explained below. FIG. 4 also illustrates additional encoding required to mask out the trailing bits during overlap in order to keep track of the lead bit.

By choosing the vernier resolution to be an integer value that is a power of two, the encoding of encoder 35 will yield a direct conversion of the output of counter circuit 15 and delay circuit 17. FIG. 5 illustrates an example where the clock period is 16 and the desired resolution is $T_o$ / 16. With these values, delay line 31 uses 16 taps to obtain a 1/16 resolution. These 16 taps are encoded by encoder 35 into a 4-bit vernier word describing a number between 0 and $2^4-1$, or 15. The output of encoder 35 increments from 0 to 15 as the pulse advances and counter 21 increments every 16 increments of encoder 35.

The counter word least significant bit (LSB) occupies the $2^4$ bit position of a word comprised of both the output of counter circuit 15 and delay circuit 17. If counter 21 is an eight bit counter, the output word is arranged as:

$$2^{11}2^{10}2^{9}2^{8}2^{7}2^{6}2^{5}2^{4}2^{3}2^{2}2^{1}2^{0}$$

which may be related to the outputs of counter 21 and encoder 35 as follows:

$$\text{(MSB) } C_8C_7C_6C_5C_4C_3C_2C_1V_4V_3V_2V_1\text{(LSB)}$$

In this example, a resolution of 1/16 the period of pulse generator 14 yields a full scale resolution of $\frac{1}{2}^{12}=1/4096$.

For measuring time intervals, the outputs of counter circuit 15 and delay circuit 17 may be directed to various data collection and processing devices, which will convert the data into a time interval in seconds, with the appropriate precision. To convert the stored data from counter circuit 15 and delay circuit 17, the following equation is used:

$$t=(T*C)+V$$

where T is the period of pulse generator 13, C is the counter word, and V is the vernier word. T and V have the same units of time. Using binary arithmetic, the counter word multiplication is accomplished by shifting bit positions. Each shift toward the most significant bit yields a multiplication of two. Using the example of FIGS. 4 and 5, the output is:

$$t=(16\times C)+V$$

Thus, for an arbitrary period and a binary value of resolution, the conversion process is simple. For example, if C=4, T=16 seconds, and V=10 seconds, then t=74 seconds.

Although the above description is in terms of a pulse transit time through delay line 31 equal to the period, $T_o$, of pulse generator 13, other values for the pulse transit time may be used with accommodations made in the manner of keeping track of the output of encoder 35. For example, the pulse transit time may be one-half of $T_o$, in which case, to produce the correct output from encoder 35, delay circuit 17 would alternate between sensing leading zeros and leading ones. The tap spacing is determined as explained above, based on the desired resolution.

The circuit elements described above have not been limited to any particular peripheral equipment. It should be understood that logic circuit could also be configured to be delivered to a peripheral device, such as a spectrum accumulator. If the invention is used with a spectrum accumulator, data is transferred to a host computer's spectrum accumulator in a parallel fashion. This transfer is initiated with a "start" signal from logic circuit 11. Logic circuit 11 inhibits further conversions until receipt of a "complete" signal from the host. This prevents data contamination during a readout of the circuits of FIG. 1.

Other applications of the invention are directed to frequency measurement. Rather than measuring an arbitrary time interval, the number of pulses within a known time interval are divided by a pulse count. Thus, not only is the number of complete pulses counted, but a vernier representation of pulses between counts is provided. Delay circuit 17 provides a pulse to pulse measurement, which permits the propagation of a single pulse to be examined.

An advantage of the invention is that the elements used to implement the invention may be comprised of integrated circuits. The ease with which these elements may be fabricated leads to another aspect of the invention, which is an integrated circuit or chip set that includes a special processor for making the above described conversion of the counter word and vernier word.

Finally, the configuration of the invention permits a high processing speed. In turn, this permits measurement of an event rate as high as one-half the period of pulse generator 13.

Although the invention has been described with reference to specific embodiments, this description is not meant to be construed in a limiting sense. Various modifications of the disclosed embodiment, as well as alternative embodiments of the invention will become apparent to persons skilled in the art upon reference to the description. It is, therefore, contemplated that the appended claims will cover such modifications that fall within the true scope of the invention.

What is claimed is:

1. A device for measuring time by counting the number of occurrences of a pulse having a known period and any increment of said pulse between a random start signal and a random stop signal, comprising:

a logic unit for receiving a start signal and a stop signal, wherein said logic means generates a start control signal in response to said start signal to be communicated to a pulse generator and a stop control signal in response to said stop signal to be communicated to a counter latch and a delay latch;

a pulse generator for generating a periodic pulse signal, having a known period, said pulse generator being initialized by said start signal;

a digital counter for receiving said pulses, and for counting occurrences of said pulses;

a counter latch for receiving the output of said counter, and for capturing said output of said counter in response to said stop signal;

a tapped delay means for receiving said pulses, and for delaying each of said pulses, wherein the total delay of said delay means is no greater than the period of pulses from said pulse generator;

a delay latch for receiving the output of said delay means, wherein said latch has a number of bit positions that correspond to the number of taps of said delay means and wherein each bit position of said latch corresponds to said pulse such that an edge of said pulse tracks a lead bit;

a decoder means for converting an output pattern of said delay latch to a set of bits representing a portion of said pulse period; and an offset adjustment means for adding a set of offset bits to the output of said decoder means, such that the output of said decoder means is zero at each new increment of said counter.

2. The device of claim 1, wherein said pulse generator is a gated oscillator, enabled in response to said start signal.

3. The device of claim 1, wherein said delay means delays said signal for a time interval equal to one period of said periodic signal.

4. The device of claim 1, wherein said offset adjustment means has a register for storing said offset bits and an adder for adding said offset bits to said output of said decoder.

5. The device of claim 4, wherein said register releases said offset bits to said adder in response to the same signal that activates said counter latch and said delay latch.

6. The device of claim 1, wherein the number of taps of said delay line is an integer power of two, such that conversion of a pulse increment to time can be accomplished by binary bit shifting.

7. The device of claim 1, wherein said tapped delay means has a delay that is one half the period of said pulses.

8. A device for measuring time by counting the number of occurrences of a pulse having a known period and any increment of said pulse between a random start signal and a random stop signal, comprising:

a logic unit for receiving a start signal and a stop signal, wherein said logic means generates a start control signals in response to said start signal to be communicated to a pulse generator and a stop control signal in response to said stop signal to be communicated to a counter latch and a delay latch;

a pulse generator for generating a periodic pulse signal, having a known period, said pulse generator being initialized by said start signal;

a tapped delay means for receiving said pulses, and for delaying each of said pulses, wherein the total delay of said delay means is no greater than the period of pulses from said pulse generator;

a delay latch for receiving the output of said delay means, wherein said latch has a number of bit positions that correspond to the number of taps of said delay means and wherein each bit position of said latch corresponds to said pulse such that an edge of said pulse tracks a lead bit and wherein said delay latch is a transparent latch;

a decoder means for converting an output pattern from said delay latch to a set of bits representing a portion of said pulse period;

a digital counter for receiving an output of said transparent latch, such that said counter counts occurrences of said pulses; and a counter latch for receiving the output of said counter, and for capturing said output of said counter in response to said stop signal.

9. The device of claim 8, wherein the number of taps of said delay means is an integer power of two, such that conversion of a pulse increment to time can be accomplished by binary bit shifting.

10. The device of claim 8, wherein said tapped delay means has a delay that is one half the period of said pulses.

11. A method of measuring an interval of time by counting the number of occurrences of a pulse having a known period and any increment of the pulse between a random start signal and a random stop signal, comprising the steps of:

using a start signal to begin a series of uniform pulses generated by a pulse generator;

simultaneously delivering said pulses to a counter and to a delay line;

using said counter to count the number of occurrences of said pulse;

using a latch to latch the output of said counter upon receipt of a stop signal, wherein the output of said latch represents a counter word representing an integer number of said pulses counted between said start signal and said stop signal;

tapping said delay line to capture the position of a leading bit of said pulse;

using a latch to latch the output of said delay line upon receipt of said stop signal;

using an encoder to convert the output of said delay latch to a vernier word representing an increment of said pulse; and multiplying said counter word by the period of said pulse and adding the value of said vernier word.

12. The method of claim 11, wherein said delay line is tapped with an integer power of two number of taps, and said multiplying step is performed by binary multiplication.

* * * * *